United States Patent [19]

Atago et al.

[11] Patent Number: 4,467,771

[45] Date of Patent: Aug. 28, 1984

[54] SINGLE POINT ELECTRONIC FUEL INJECTION SYSTEM

[75] Inventors: Takeshi Atago; Toshio Manaka, both of Katsuta, Japan

[73] Assignee: Hitachi, Ltd., Tokyo, Japan

[21] Appl. No.: 395,325

[22] Filed: Jul. 6, 1982

[30] Foreign Application Priority Data

Jul. 6, 1981 [JP] Japan ..... 56-104485

[51] Int. Cl.[3] ..... F02B 3/00

[52] U.S. Cl. ..... 123/490; 123/472

[58] Field of Search ..... 123/472, 490, 333, 335

[56] References Cited

U.S. PATENT DOCUMENTS

| | | | |
|---|---|---|---|
| 3,898,963 | 8/1975 | Iwata | 123/490 |
| 4,153,014 | 5/1979 | Sweet | 123/490 |
| 4,196,702 | 4/1980 | Bowler | 123/490 |

*Primary Examiner*—Ronald B. Cox

*Attorney, Agent, or Firm*—Antonelli, Terry & Wands

[57] ABSTRACT

In a single point electronic fuel injection system for injecting fuel at the upstream side of a throttle valve in synchronism with the sucking stroke of engine, upon low-speed driving, particularly upon idling drive, the total amounts of fuel necessary for a previous sucking stroke and the following sucking stroke are injected at a time in the previous sucking stroke and no fuel is injected in the following sucking stroke.

3 Claims, 8 Drawing Figures

SINGLE POINT ELECTRONIC FUEL INJECTION SYSTEM

This invention relates to fuel injection apparatus for use in internal combustion engine, and particularly to single point electronic fuel injection system arranged to inject fuel from a single electromagnetic fuel injection valve which is provided upstream of a throttle valve disposed in a suction path.

In general, the single point electronic fuel injection system, in which a single electromagnetic fuel injection valve supplies fuel to all the cylinders of the internal combustion engine, has features of a small number of electromagnetic fuel injection valves used, a small number of fuel pipes used and no need to provide, in a control circuit, a distributing means for distributing a valve open signal to each electromagnetic fuel injection valve, as compared with the multipoint electronic fuel injection system having multiple electromagnetic fuel injection valves respectively provided at all the suction cylinders communicating with the cylinders. For example, U.S. Pat. No. 4,196,702 shows a single point electronic fuel injection system.

Also, in this single point electronic fuel injection system, fuel is injected from the electromagnetic fuel injection valve in synchronism with the rotation of the internal combustion engine. In other words, in the 4-cylinder 4-cycle internal combustion engine, the sucking stroke is performed at each cylinder in the order of the first, third, fourth and second cylinders, and fuel is injected from the electromagnetic fuel injection valve in synchronism with this sucking stroke.

Therefore, in such single point electronic fuel injection system, it is necessary that fuel be supplied by a single electromagnetic fuel injection valve over a wide range from idling drive to high speed drive, and specifically the electromagnetic fuel injection valve is opened for 1.0 ms at idling drive and for 5.0 ms at high-speed drive.

However, there is a drawback that in the low speed driving condition, the electromagnetic fuel injection valve is opened for a very short time tc inject and the fuel is inadequately atomized so that the internal combustion engine does not rotate smoothtly.

The reason why the fuel injected from the electromagnetic fuel injection valve at this low-speed driving condition is not well atomized is that under low-speed driving condition, the amount of injected fuel (or valve-opening time) is small resulting in small spread angle at which fuel is not well atomized because the fuel injected from the electromagnetic fuel injection valve is injected at a certain spread angle by which the degree of the atomization of fuel is affected such that the larger the spread angle, the better the atomization of fuel, and which is decreased as the amount of fuel injection (or valve-opening time) is reduced. Particularly in idling drive, the spread angle is extremely small.

It is an object of the invention to provide a valve-opening time control means for an electromagnetic fuel injection valve, which is capable of atomizing fuel injected from electromagnetic fuel injection valve under low-speed driving condition. The feature of the control means is that since when fuel is injected at the upstream side of a throttle valve, the fuel is delayed due to the distance from the collecting portion of a suction manifold communicating to each cylinder to the throttle valve, and thus under low-speed condition the total amounts of fuel necessary for both a previous sucking stroke and the following sucking stroke (i.e., a pair of consecutive sucking strokes) can be injected at a time during the previous sucking stroke without any trouble to the rotation of the internal combustion engine; therefore, according to the invention, the low-speed driving condition is detected and a valve-opening signal is supplied from the control means to the electromagnetic fuel injection valve so that the total amounts of fuel necessary for both the previous sucking stroke and the following sucking stroke can be injected at a time in the previous sucking stroke.

The present invention will be apparent from the following detailed description taken in conjuction with the accompanying drawings, in which:

FIG. 1. is a construction diagram of a single point electronic fuel injection system to which this invention is applied;

Figure 1:
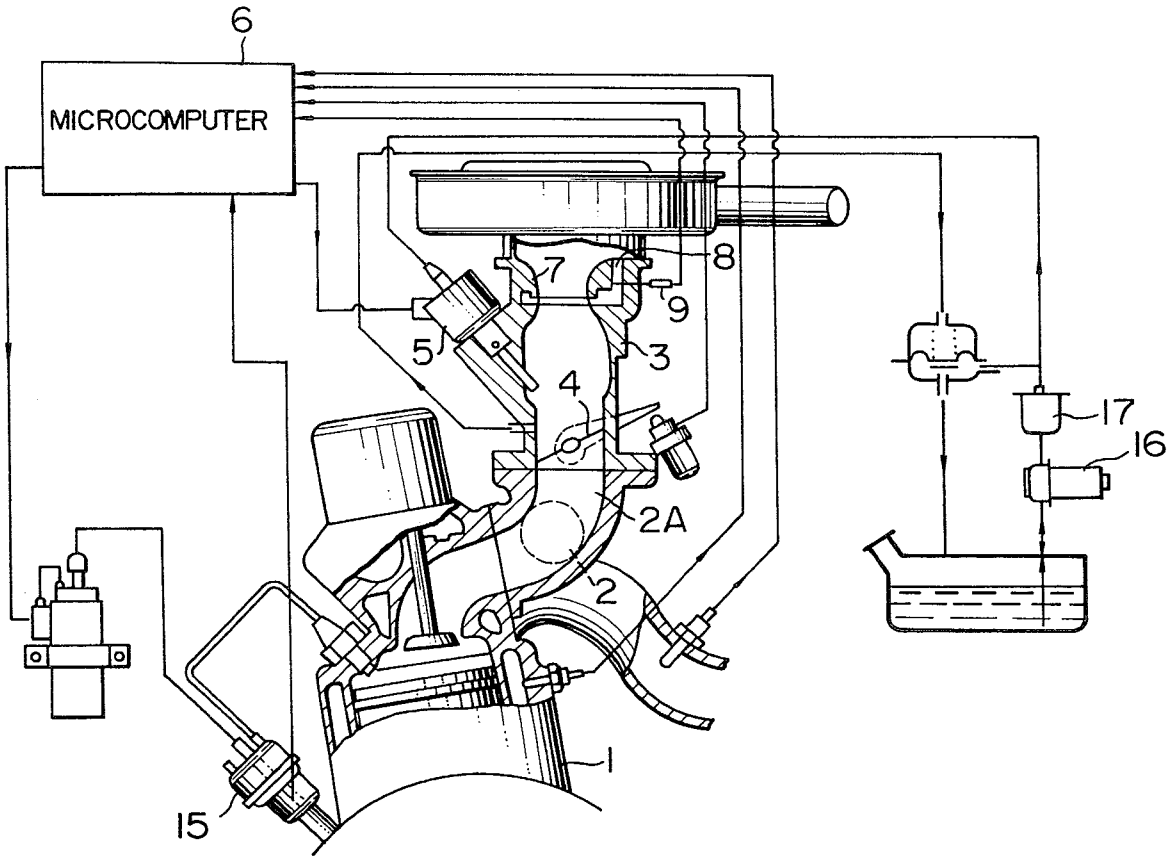
FIG. 1 shows the whole arrangement of an engine to which this invention is applied.

Referring to FIG. 1, there is shown an air suction pipe 2 through which each cylinder of an engine 1 is communicated with an air suction collecting portion 2A, to which a throttle chamber 3 is mounted. This throttle chamber 3 has provided therein a throttle valve 4 for controlling the amount of air to be sucked into the engine 1 and, at the upstream side of the throttle valve 4, an electromagnetic fuel injection valve 5 for injecting a fuel. Also, a Venturi tube 7 and an air path 8 for the measurement of the amount of air to be sucked are provided in parallel at the upstream side of the electromagnetic injection valve 5. In the air path 8 is mounted a heater type air flow sensor 9, an output signal from which is supplied to a microcomputer 6. On the other hand, the number of rotations of the engine is detected by a rotational-frequency sensor incorporated in a distributor 15 and a digital signal corresponding to the number of rotations is supplied to the microcomputer 6.

The supply of fuel to the engine 1 is performed such that signals indicative of engine operating conditions are applied to the microcomputer 6, which then computes the time of valve opening, or duration of pulse and supplies such pulse to the injection valve 5 in synchronism with the air sucking process for the engine, thereby allowing the valve 5 to pass therethrough an amount of fuel which is compressed by a fuel pump 16 supplied through a fuel filter 17 to the valve 5, so that the compressed fuel is injected from the valve 5 to the throttle valve 4 and then delivered to the engine.

Figure 2:
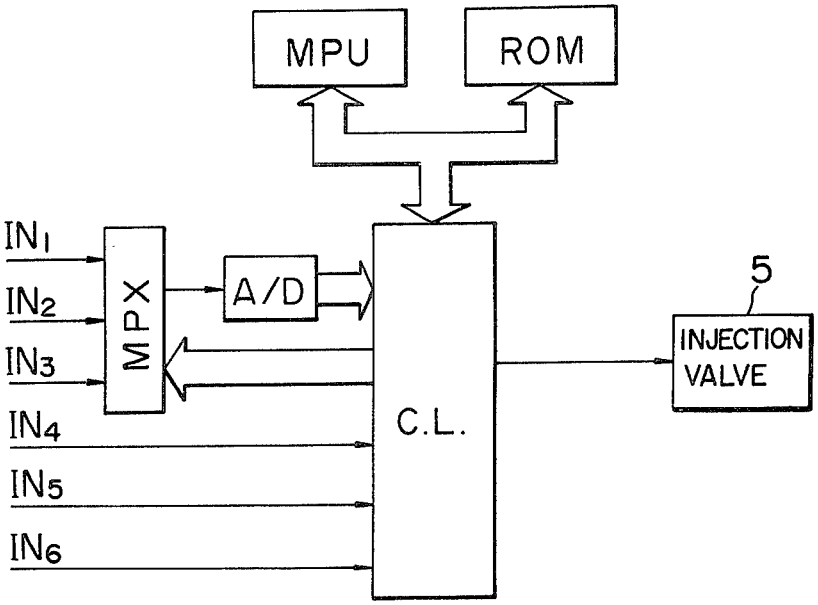
FIG. 2 shows an arrangement of a microcomputer.

FIG. 2 shows the logic within the microcomputer 6. Digital signals of the rotational frequency of the engine and so on, designated by IN 4 to IN 6 are applied directly to a control logic CL, and analog signals indicative of the amount of air flow from the heater type flow meter and so on, designated by IN1 to IN3 are applied through an analog-to-digital converter A/D to the control logic CL. If the number of analog signals is large, a multiplexer MPX can be used to select signals by switching. The control logic CL transmits and receives data to and from a microprocessor unit MPU and a memory ROM and supplies a pulse of the duration corresponding to each input, to the electromagnetic fuel injection valve 5.

Figure 3:
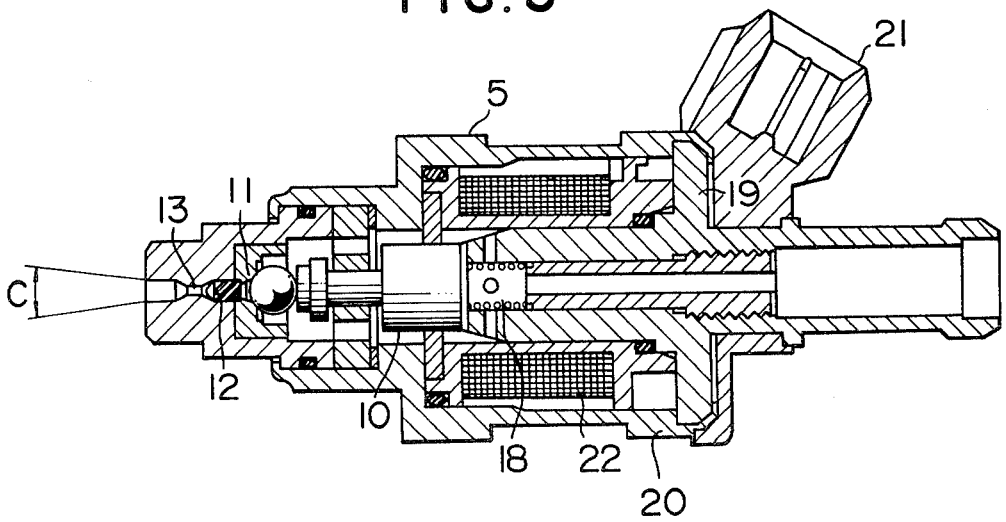
FIG. 3 is a cross-sectional diagram of an electromagnetic fuel injection valve.

The construction of the electromagnetic fuel injection valve 5 will be described with reference to FIG. 3. Reference numeral 10 represents a plunger, 11 a ball valve, 12 a swirler, 13 an orifice, 18 a spring, 19 a core, 20 a yoke, and 21 a connector to be connected to the control unit. In this valve 5, fuel that is always compressed at pressure of 0.7 $Kg/cm^2$ is normally cut off by the ball valve 11 being pushed by the spring 18. When the fuel is desired to be injected from the valve 5, current corresponding to the necessary amount of fuel is supplied to a solenoid 22 to thereby move the plunger 10, opening the ball valve 11, so that the fuel is injected at a spread angle C from the orifice through the swirler 12.

Figure 4:
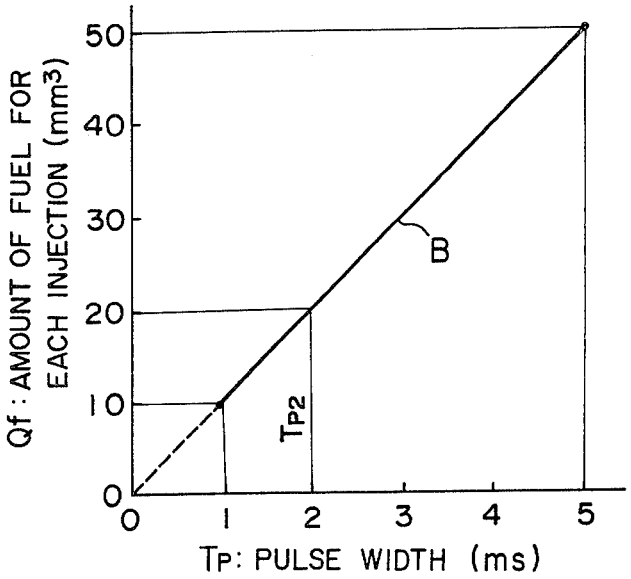
FIG. 4 shows the relation between the injected pulse width and fuel injection amount.

The characteristics of such valve is shown in FIG. 4. If, now, a demanded fuel characteristic of a 2000-cc 4-cylinder engine is represented by B, the pulse duration per air suction process is 5 ms at rotational frequency 6000 rpm of engine and thus the amount of fuel to be injected is 50 $mm^3$. When the fuel injection rate, 50 $mm^3$ is selected for 5 ms of pulse duration, the necessary amount of fuel upon idling lies in the straight line passing through origin O, and thus is 10 $mm^3$ for pulse duration of 1 ms.

Figure 5:
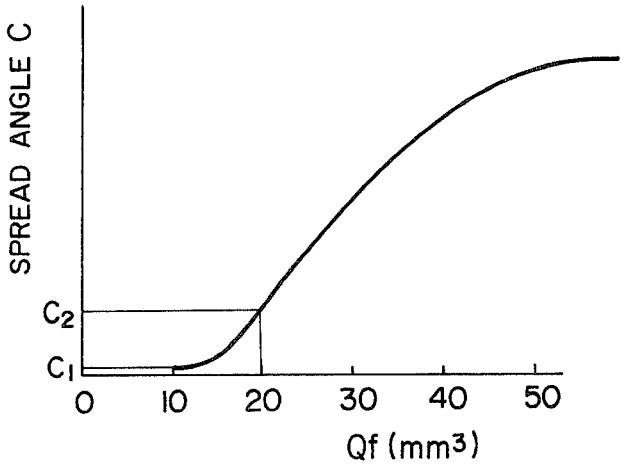
FIG. 5 shows the relation between the amount of fuel from the fuel injection valve and the spread angle.

FIG. 5 shows the relation between the amount of fuel injection and the spread angle of fuel injection from the electromagnetic fuel injection valve. From FIG. 5, it will be seen that the spread angle $C_2$ at 20 $mm^2$ becomes much larger than the angle $C_1$ at 10 $mm^2$.

Therefore, a two-fold amount of fuel flow upon idling, or about 20 $mm^3$ of fuel can be obtained by selecting the pulse width of about 2 ms as shown in FIG. 4, giving a sufficient spread angle. However, the fuel injection of 20 $mm^3$ upon idling is excessive. Thus, it is necessary to inject no fuel in the sucking stroke after fuel injection, but if such fuel injection is used in all driving conditions, it will cause a problem of rotation variation upon middle-and high-speed driving. This is because upon middle-and high-speed driving, air is flowed at a high speed through the suction path and suction manifold, and most fuel is supplied to the cylinder associated with the sucking stroke in which fuel is injected, but almost no fuel is supplied to the cylinders associated with the sucking stroke in which no fuel is injected. Accordingly, under such condition, fuel must be injected at each sucking stroke.

On the other hand, it was found that since under low-speed conditions including idling condition, air is flowed at a low speed through the suction path and suction manifold, the total amount of fuel in the previous sucking stroke and the following sucking stroke can all be injected upon the sucking stroke without any trouble to the rotation of internal combustion engine. Therefore, it is satisfactory that the low-speed driving condition be detected, and the total amount of fuel necessary for the previous sucking stroke and the following sucking stroke be injected in the previous sucking stroke.

The way of such control will be described with reference to FIG. 6 which shows the relation between the rotational angle and cycle of each cylinder.

Figure 6:
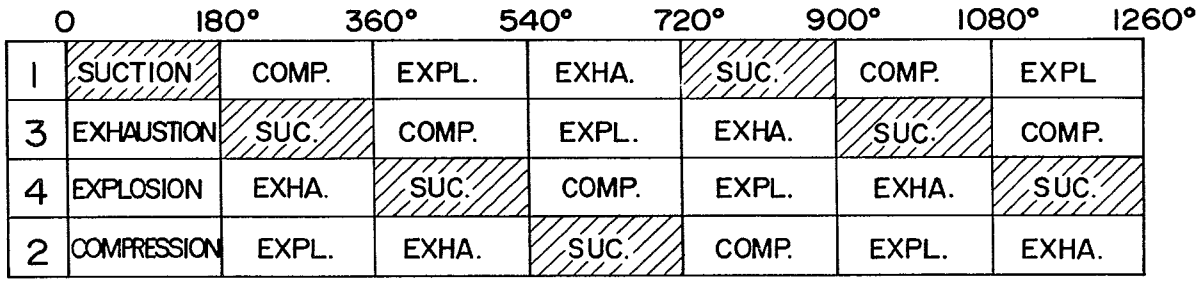
FIG. 6 is an explanatory diagram useful for explaining the cycle of a 4-cylinder 4-cycle engine.

Referring to FIG. 6, the first cylinder performs suction, compression, explosion and exhaustion in turn at each 180° to complete one cycle with two rotations. On the other hand, the third, fourth and second cylinders repeat the same cycle with a respective delay of 180°. Thus, in this invention, in each of the first and third cylinders, the total amounts of fuel to be supplied to those cylinders are injected in the sucking stroke of the first cylinder, but no fuel is injected in the sucking stroke of the third cylinder. Similarly, the total amounts of fuel to be supplied to the fourth and second cylinders are injected in the sucking stroke of the fourth cylinder, but no fuel is injected in the sucking stroke of the second cylinder. Such a manner of injection will also be described with reference to FIG. 7 for only the sucking stroke. In the sucking stroke of the first cylinder, the amounts, $f_1$ and $f_3$ of fuel to be necessary for the sucking strokes of the first and third cylinders are injected, and in the sucking stroke of the third cylinder, the amount $f_3$ of fuel is not injected. Similarly, in the sucking stroke of the fourth cylinder, the amounts, $f_4$ and $f_2$ of fuel necessary for the sucking strokes of the fourth and second cylinders are injected, and in the sucking stroke of the second cylinder, the amount $f_2$ of fuel is not injected.

Figure 8:
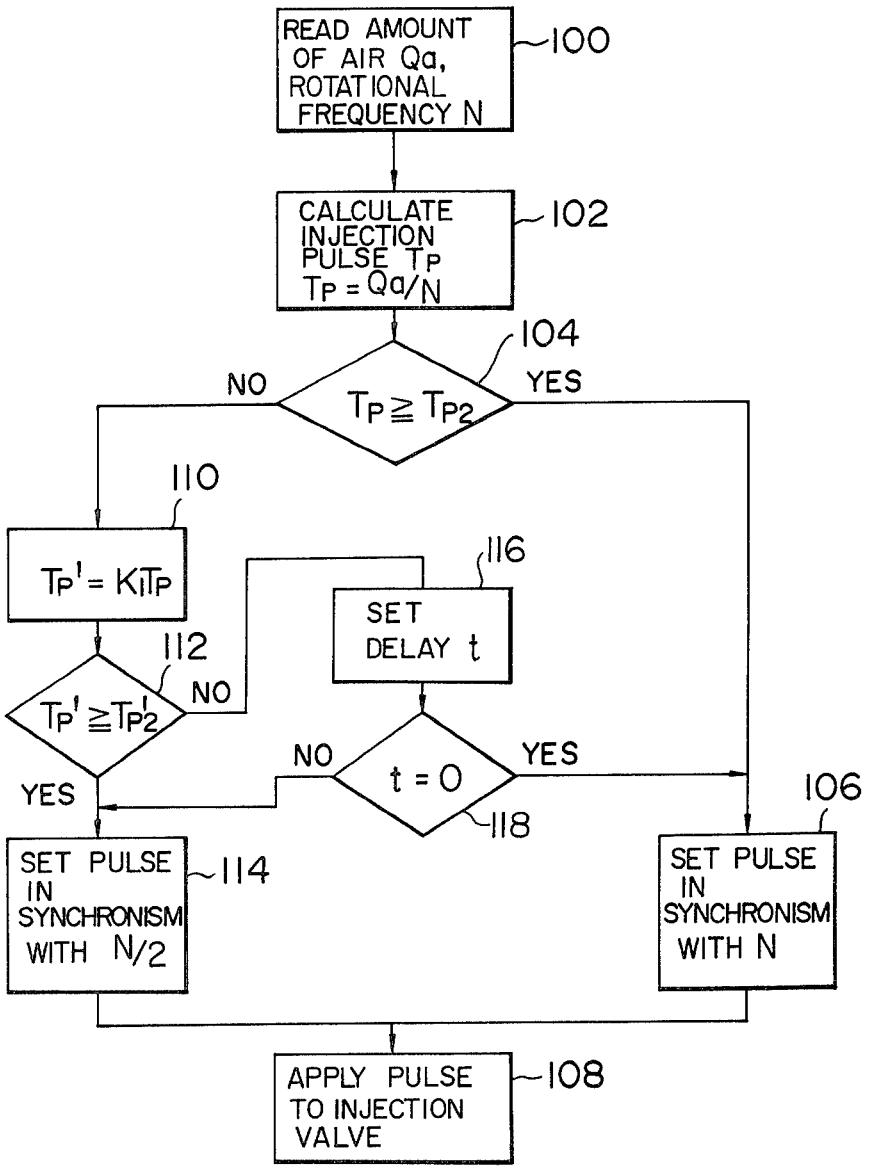
FIG. 8 is a flow chart showing one embodiment of this invention.

A specific way of achieving such a control will next be described with reference to FIG. 8.

At step 100, an amount of air $Q_a$ is measured by the air flow meter 9 and the number of rotations N by the rotational frequency sensor 15. At the next step 102, an injection pulse $T_p$ indicative of an amount of fuel necessary for the first sucking stroke is calculated, where $T_p$ is expressed by $Q_a/N$. At step 104, a decision is made of whether the injection pulse calculated at step 102 is greater than or equal to a predetermined injection pulse $T_{p2}$. This predetermined injection pulse $T_{p2}$ is a reference for deciding the state of the internal combustion engine. If the pulse $T_p$ calculated at step 102 is lower than the predetermined pulse $T_{p2}$, it represents low-speed driving. If it is larger than the $T_{p2}$, it shows middle-and high-speed driving. Here, $T_{p2}$ shown in FIG. 4 is used. If at step 104, the pulse $T_p$ is larger than the predetermined pulse $T_{p2}$, the pulse synchronized with the number N of ratations of engine is set at step 106. Then, at step 108, the pulse based on the pulse $T_p$ is applied to the injection valve. That is, in this case, fuel is injected during the sucking stroke of each cylinder.

Figure 7:
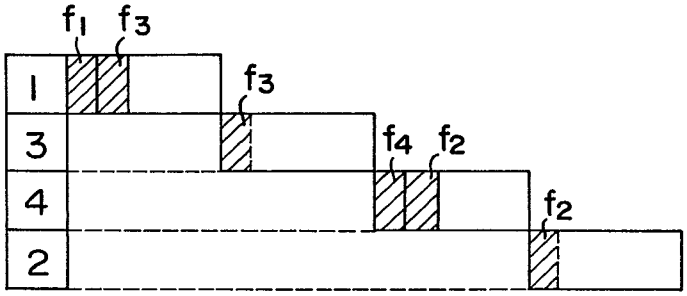
FIG. 7 shows the relation between the sucking stroke and fuel injecting time, useful for explaining the invention.

On the other hand, at step 104, if the pulse $T_p$ is smaller than the predetermined pulse $T_{p2}$, the program goes to step 110, where $T_p'$ is calculated by multiplying the $T_p$ calculated at step 102 by $K_1$ (usually, two). Then, at step 112, a decision is made of wheter or not the value $T_p'$ determined at step 110 is larger than or equal to the value $T_{p2}'$ which is $K_2$ times the predetermined pulse $T_{p2}$ for a reference at step 104. If, at step 112, $T_p'$ is larger than or equal to $T_{p2}'$, the pulse synchronized with $\frac{1}{2}$ the number of rotations N as shown in FIG. 7 is set at step 114. In other words, a pulse is set for the amount of fuel necessary in the previous sucking stroke and the following sucking stroke to be injected in the previous sucking process (i.e., a pusle is set which will supply a quantity of fuel during the first of the paired, first and third or fourth and second, suction strokes that is equal to that required to be injected for both of the paired sucking strokes); or in FIG. 7, such pulse is the pulse $T_p'$ corresponding to the total amount of fuel $f_1+f_3$ necessary for the first and third cylinders, and this pulse is applied to the injection valve in the first sucking stroke. Of course, this also applies for the fourth and second cylinders. At step 108, the pulse based on this pulse $T_p'$ is supplied to the injection valve. The reason for the provision of step 112 is that when the pulse $T_p$ calculated at step 102 is close in value to the predetermined pulse $T_{p2}$, a hunting phenomenon occurs which repeats alternately the state in which fuel is injected at each sucking stroke and the state in which the amounts of fuel for two sucking strokes are injected at a time in one sucking stroke, and therefore in order to prevent this the predetermined pulse $T_{p2}$ as a reference for decision is provided with a hysteresis determined by $K_2$. Also, if at step 112, $T_p'$ is smaller than $T_{p2}$, delay t is set at step 116 and then at step 118 decision is made of whether the delay t is zero or not. In this case, at step 116 delay time is subtracted by a soft timer, and when at step 118 t=0, the program goes to step 106. If a step 118, t is not equal to zero, the program goes to step 114. The steps 116 and 118 are effective for preventing the hunting phenomenon.

As described above, according to this invention, fuel injected from valve can be fully atomized at low-speed driving, thus the variation of rotation of engine being suppressed.

While in this embodiment the low-speed driving is detected by injection pulse, it can be detected by detecting rotational frequency, the position of the throttle valve or others.

We claim:

1. A single point electronic fuel injection system for a four cycle reciprocating engine having an electromagnetic fuel injection valve upstream of a throttle valve provided in a suction path in which a suction manifold is connected and to which a plurality of cylinders are communicated, a sensor for detecting the amount of air to be sucked, a rotational frequency sensor for detecting the number of rotations of the engine, and electronic control means, the output signals from said sensors being applied to said electronic control means, which then calculates on the basis of the inputs an injection pulse and supplies the injection pulse, in synchronism with said engine, to said electromagnetic fuel injection valve, thereby causing said valve to inject fuel in accordance with the pulse, said single point electronic fuel injection system being characterized in that, when any low-speed driving condition is detected by low-speed driving detection means, total amounts of fuel necessary for pairs of consecutive sucking strokes are injected at a time in the first of the paired consecutive sucking strokes and no fuel is injected in the following sucking stroke of the pair by controlling the injection pulse by said electronic control means, and in middle-and high-speed driving conditions, injection pulses are provided in synchronism with each suction stroke.

2. A single point electronic fuel injection system according to claim 1, wherein said low-speed driving detection means is formed of comparing means for comparing an actual injection pulse determined by an amount of air to be sucked, and a rotational frequency with a predetermined injection pulse, so that when said actual injection pulse is smaller than said predetermined injection pulse, the low-speed driving condition is detected.

3. A single point electronic fuel injection system according to claim 1, wherein said predetermined injection pulse has a hysteresis provided on its value.

* * * * *